US008737881B2

(12) United States Patent
Soda et al.

(10) Patent No.: US 8,737,881 B2
(45) Date of Patent: May 27, 2014

(54) IMAGE FORMING APPARATUS HAVING TONER CHARGING MEMBERS

(75) Inventors: Shota Soda, Kashiwa (JP); Jiro Kinokuni, Abiko (JP); Michihiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 13/476,254

(22) Filed: May 21, 2012

(65) Prior Publication Data

US 2012/0301167 A1 Nov. 29, 2012

(30) Foreign Application Priority Data

May 26, 2011 (JP) ..... 2011-118272

(51) Int. Cl.
*G03G 21/14* (2006.01)

(52) U.S. Cl.
USPC ..... 399/129

(58) Field of Classification Search
USPC ..... 399/66, 44, 149, 50
See application file for complete search history.

(56) References Cited

U.S. PATENT DOCUMENTS

| | | | | |
|---|---|---|---|---|
| 6,459,872 | B1 | 10/2002 | Komiya et al. | |
| 2004/0161262 | A1 * | 8/2004 | Uyama et al. | 399/149 |
| 2007/0059000 | A1 * | 3/2007 | Shibuya | 399/44 |
| 2007/0122190 | A1 * | 5/2007 | Kitajima | 399/129 |
| 2008/0118272 | A1 * | 5/2008 | Komatsu | 399/150 |

FOREIGN PATENT DOCUMENTS

JP 2001-92330 A 4/2001

* cited by examiner

*Primary Examiner* — Quana M Grainger
(74) *Attorney, Agent, or Firm* — Fitzpatrick, Cella, Harper & Scinto

(57) ABSTRACT

An image forming apparatus includes an image bearing member, a first toner charging member, provided downstream of a transfer device and upstream of a charging device with respect to a rotational direction of the image bearing member, for electronically charging toner remaining on the image bearing member, and a second toner charging member, provided downstream of the first toner charging member and upstream of the charging device with respect to the rotational direction, for electrically charging the toner remaining on the image bearing member by being supplied with a voltage of a polarity identical to a normal charge polarity of the toner. In addition, a controller controls application of a predetermined voltage to the first toner charging member, and a first AC voltage is applied to a developer.

3 Claims, 9 Drawing Sheets

IMAGE FORMING APPARATUS HAVING TONER CHARGING MEMBERS

FIELD OF THE INVENTION AND RELATED ART

The present invention relates to an image forming apparatus of an electrophotographic type using a cleaner-less type.

In recent years, the image forming apparatus of the cleaner-less type in which an electric charge of a transfer residual toner remaining on a photosensitive member without being transferred is adjusted and then is collected by a developing device has been commercialized. The image forming apparatus of the cleaner-less type includes an adjusting member, for adjusting the electric charge of the toner in contact to the transfer residual toner remaining on the photosensitive member, at a position downstream of a transfer means and upstream of a charging means with respect to a rotational direction of the photosensitive member.

Here, the adjusting member adjusts the charge by contacting the toner and therefore the toner is accumulated on the adjusting member with continuous image formation. When the toner is excessively accumulated on the adjusting member, the toner electric charge cannot be sufficiently adjusted by the adjusting member. Therefore, Japanese Laid-Open Patent Application No. 2001-092330 discloses a constitution in which a cleaning sequence for discharging (moving) a toner deposited on an auxiliary brush onto a photosensitive member after completion of image formation.

On the other hand, toners remaining on the photosensitive member after transfer include a positive(-polarity) toner and a negative(-polarity) toner in mixture. With respect to the toners, a constitution in which two adjusting members including a member for uniformizing the polarities of the toners present in mixture and a member for providing the electric charge so that the toners are collected has been known. Specifically, a constitution provided with a first adjusting member for uniformizing the polarities of the toners present in mixture and a second adjusting member, provided downstream of the first adjusting member, to which a voltage of a polarity identical to a normal charge polarity of the toner has been known.

In the constitution provided with the plurality of the adjusting members, on the first adjusting member disposed close to a transfer portion, compared with the second adjusting member disposed downstream of the first adjusting member, the toner is liable to be accumulated since the first adjusting member adjusts the electric charges of the toners of different polarities present in mixture. The toner is deposited in a large amount and therefore it would be considered that an execution frequency of the cleaning sequence for discharging the toner accumulating on the first adjusting member onto the photosensitive member is increased.

However, when the cleaning sequence is frequently performed, a deterioration of the photosensitive member by energization and a lowering in productivity with the execution of the sequence are caused. Therefore, the present inventors studied whether or not a toner deposition amount itself on the first adjusting member can be reduced.

In a conventional image forming apparatus, at the time of completion of the continuous image formation, a voltage was applied to the first adjusting member until the transfer residual toner for a final toner image to be outputted onto a recording material (an image to be formed on a final page of continuous images) passes through the first adjusting member. On the other hand, the present inventors considered that the amount of the toner deposited on the first adjusting member is reduced by lowering the voltage applied to the first adjusting member within a range adversely affecting the image outputted onto the recording material in order to reduce the amount of the toner deposited on the first adjusting member.

Specifically, the present inventors considered that the voltage is lowered, in order to suppress the toner deposited on the first adjusting member, after a rear end of a region (where the image has not yet been formed) in which the final toner image to be outputted onto the recording material is to be formed passes through the first adjusting member and before a transfer residual toner with respect to the final toner image passes through the first adjusting member.

However, when a low voltage is applied to the first adjusting member, during passing of a region of the photosensitive member, contacting the first adjusting member to which the low voltage is applied, through an opposing portion where the photosensitive member region opposes the second adjusting member, a current passing from the second adjusting member through the photosensitive member is decreased. As a result, there arose a problem that the transfer residual toner remains on the photosensitive member without being collected by the developing means (device).

SUMMARY OF THE INVENTION

The present invention has accomplished by solving the above problem.

According to an aspect of the present invention, there is provided an image forming apparatus comprising: an image bearing member; charging means for electrically charging the image bearing member; developing means for developing with a toner an electrostatic image formed on the image bearing member simultaneously with collection of the toner remaining on the image bearing member; transfer means for transferring a toner image, formed on the image bearing member, onto a toner image receiving material; a first adjusting member, provided downstream of the transfer means and upstream of the charging means with respect to a rotational direction of the image bearing member, for adjusting an electric charge of the toner remaining on the image bearing member; a second adjusting member, provided downstream of the first adjusting member and upstream of the charging means with respect to the rotational direction, for adjusting the electric charge of the toner by being supplied with a voltage of a polarity identical to a normal charge polarity of the toner; and control means for controlling the first adjusting member and the developing means, wherein a predetermined voltage is applied to the first adjusting member during a period from a time when a rear end of a region in which the electrostatic image corresponding to an image, of a series of images designated by a job, to be finally transferred onto the toner image receiving member is to be formed passes through the first adjusting member until a time when the rear end passes through the charging means, wherein the predetermined voltage is lower in absolute value than a voltage applied to the first adjusting member until the time when the rear end passes through the first adjusting member, and wherein an AC voltage is applied to the developing means when a front end of a region of the image bearing member opposing the first adjusting member to which the predetermined voltage is applied reaches the developing means, wherein the AC voltage is higher in peak-to-peak voltage than an AC voltage applied to the developing means until the time when the front end reaches the developing means.

These and other objects, features and advantages of the present invention will become more apparent upon a consideration of the following description of the preferred embodiments of the present invention taken in conjunction with the accompanying drawings.

Figure 4:
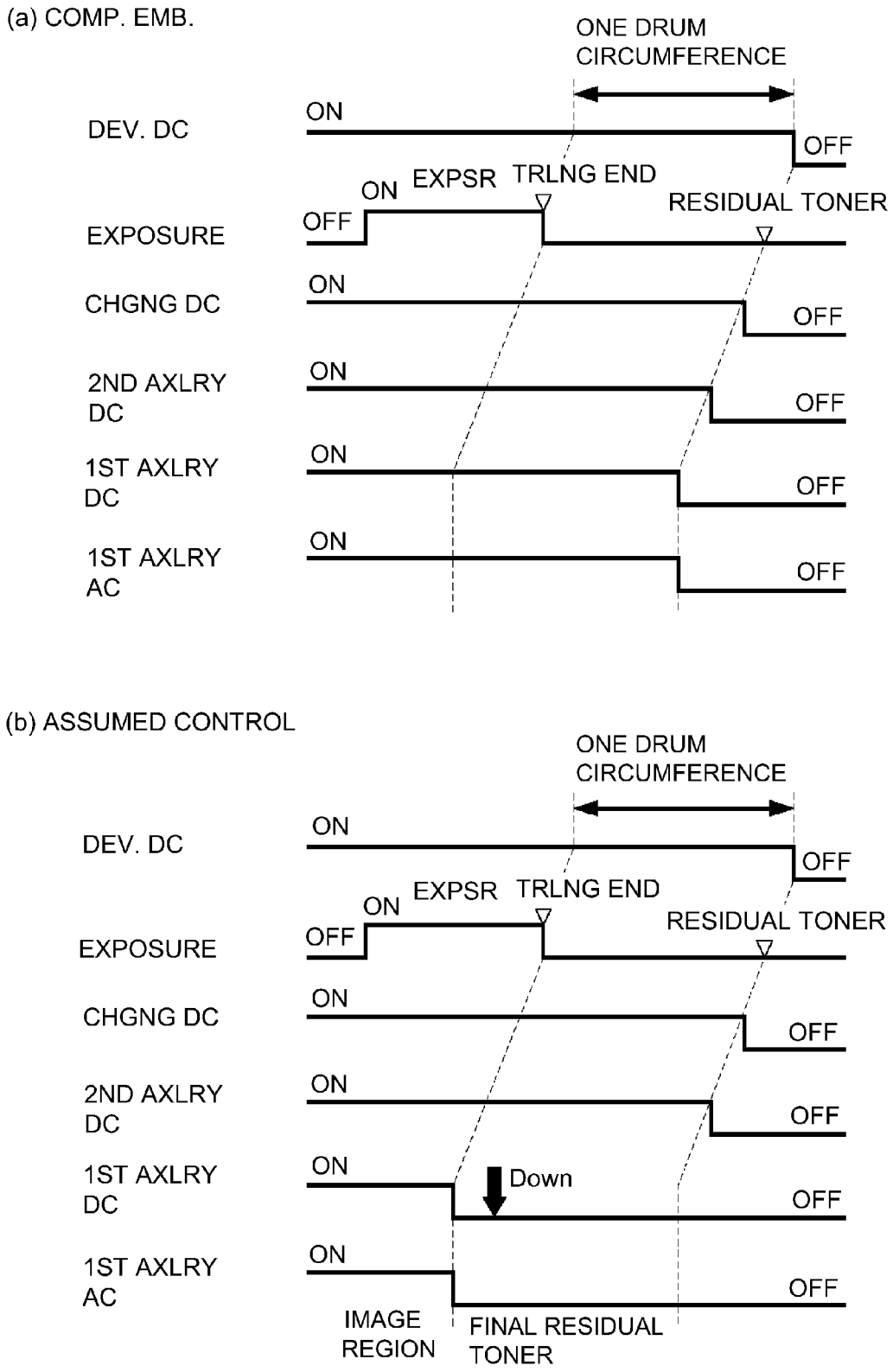

Part (a) of FIG. 4 is a timing chart of an output of a high voltage falling (lowering) mode in a conventional embodiment, and (b) of FIG. 4 is a timing chart of an output of a high voltage falling mode in the present invention.

Figure 5:
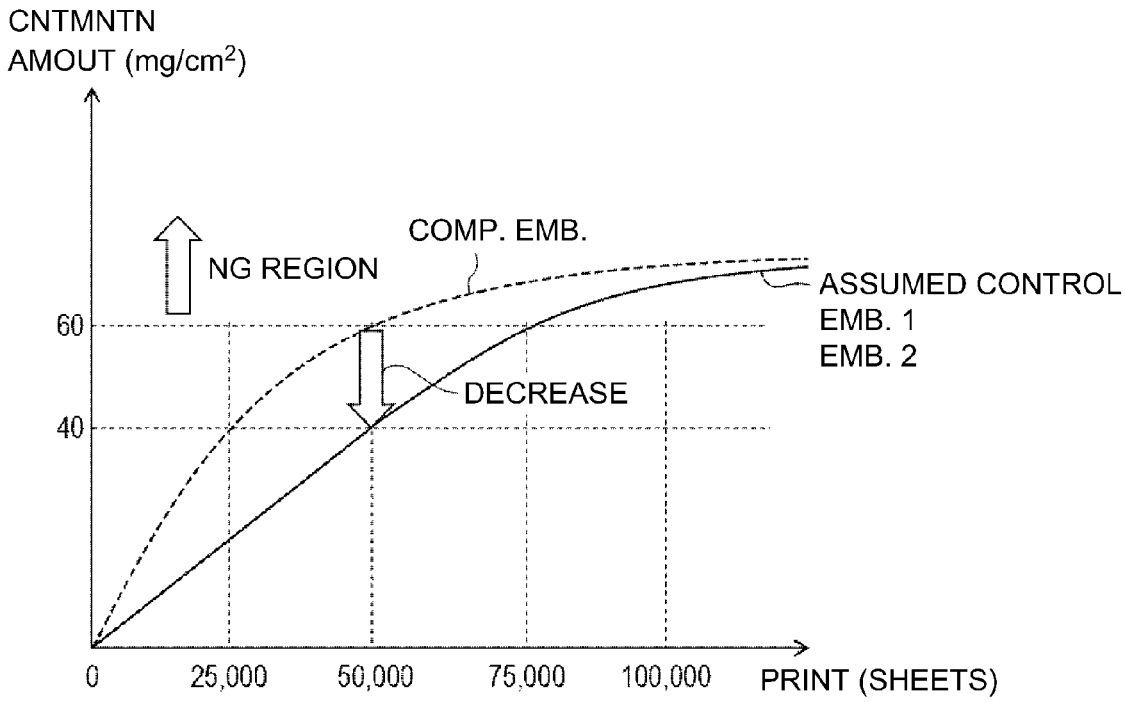

FIG. 5 is a graph showing a result of comparison between the conventional embodiment and the present invention with respect to a contamination amount by toner deposition on a first auxiliary charging brush.

Figure 6:
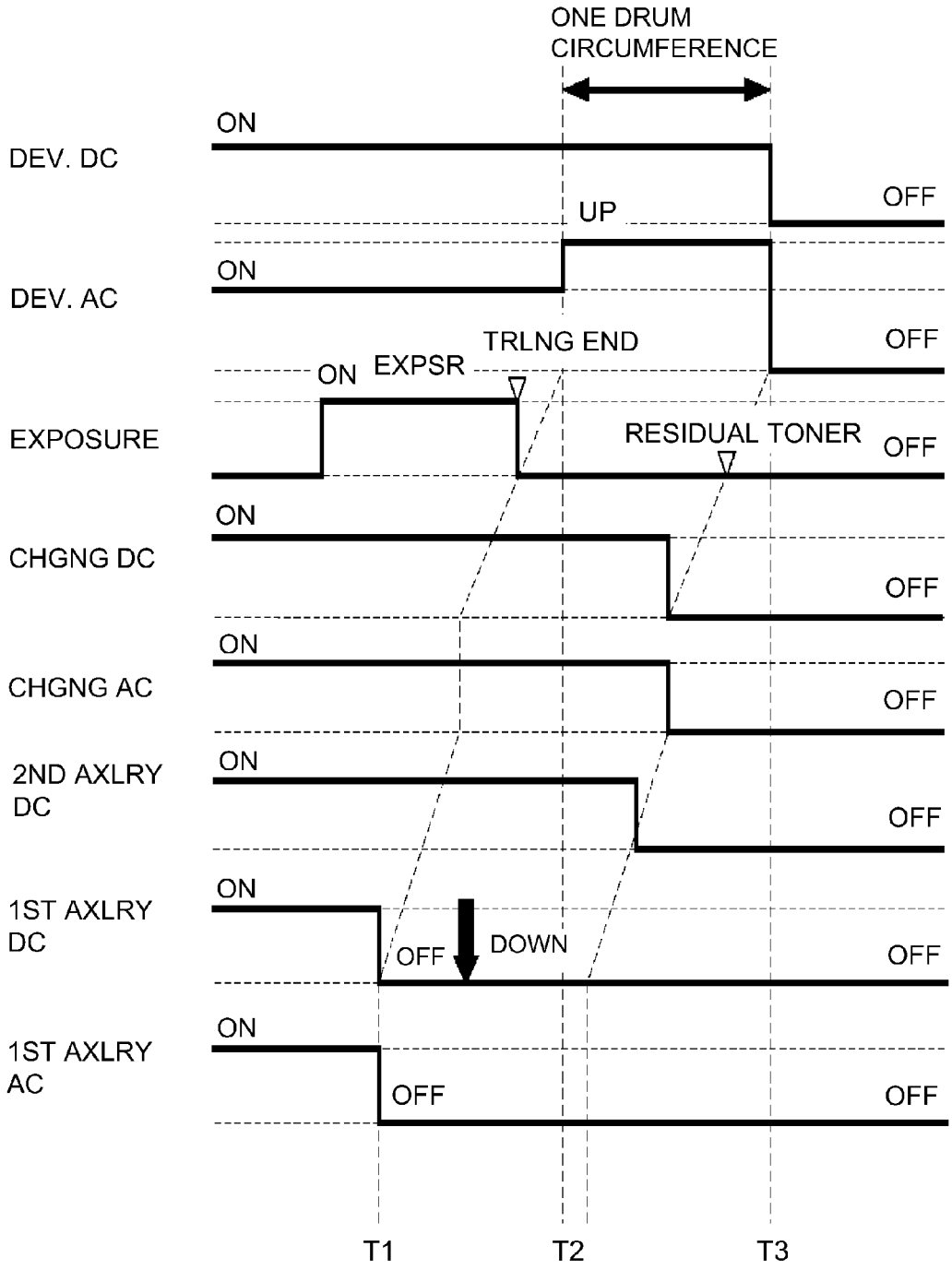

FIG. 6 is a timing chart of an output of a high voltage falling mode in the present invention.

Figure 7:
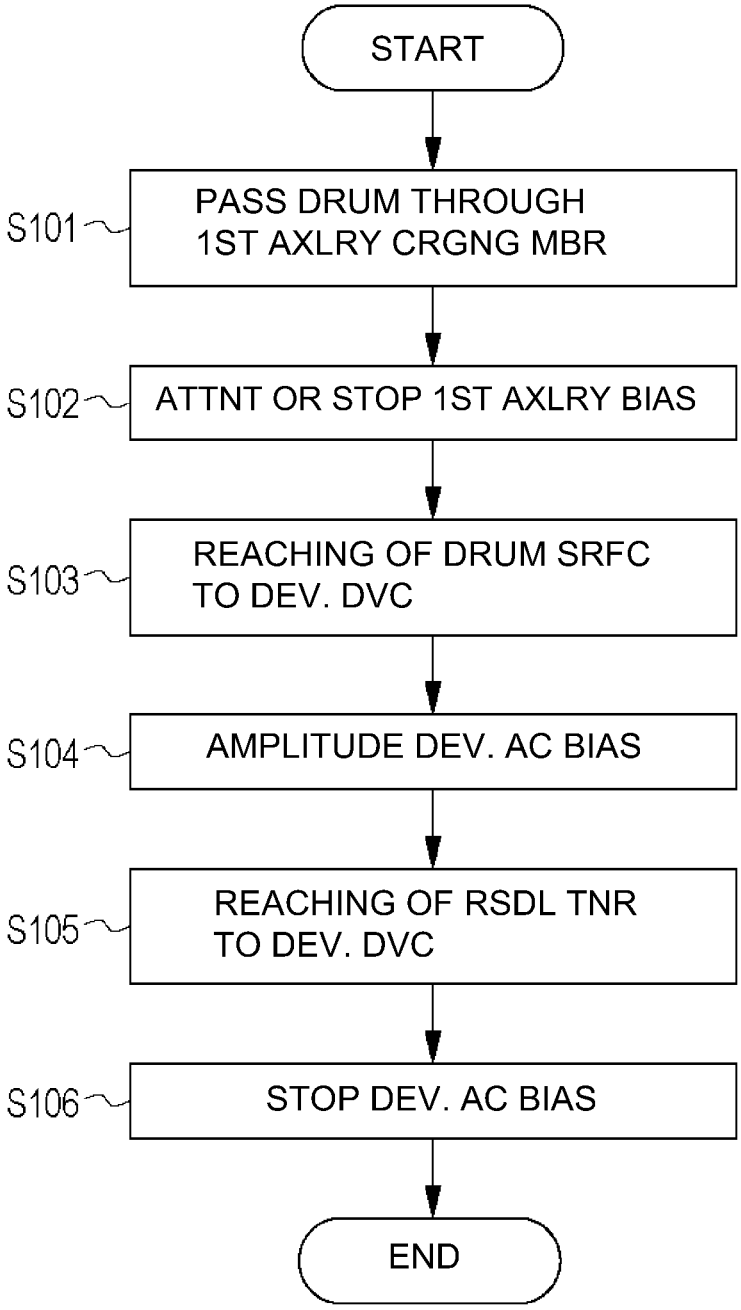

FIG. 7 is a flow chart of the output in the high voltage falling mode in the present invention.

Figure 8:
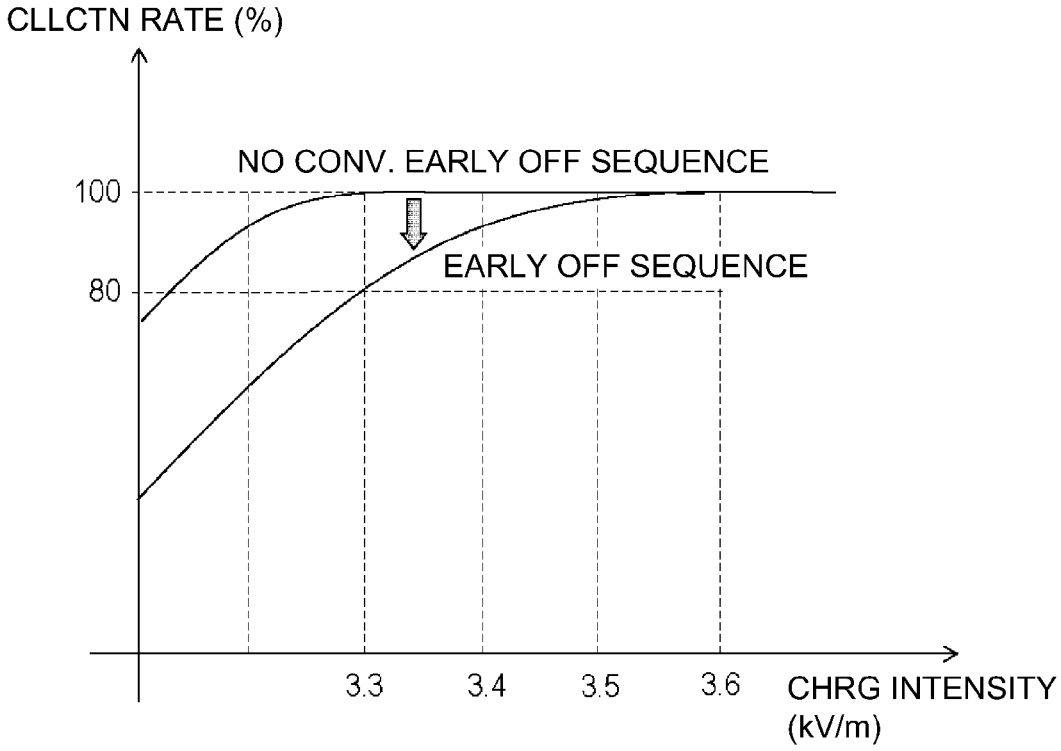

FIG. 8 is a graph for illustrating a relationship between an electric field intensity and a developer collecting property.

Figure 9:
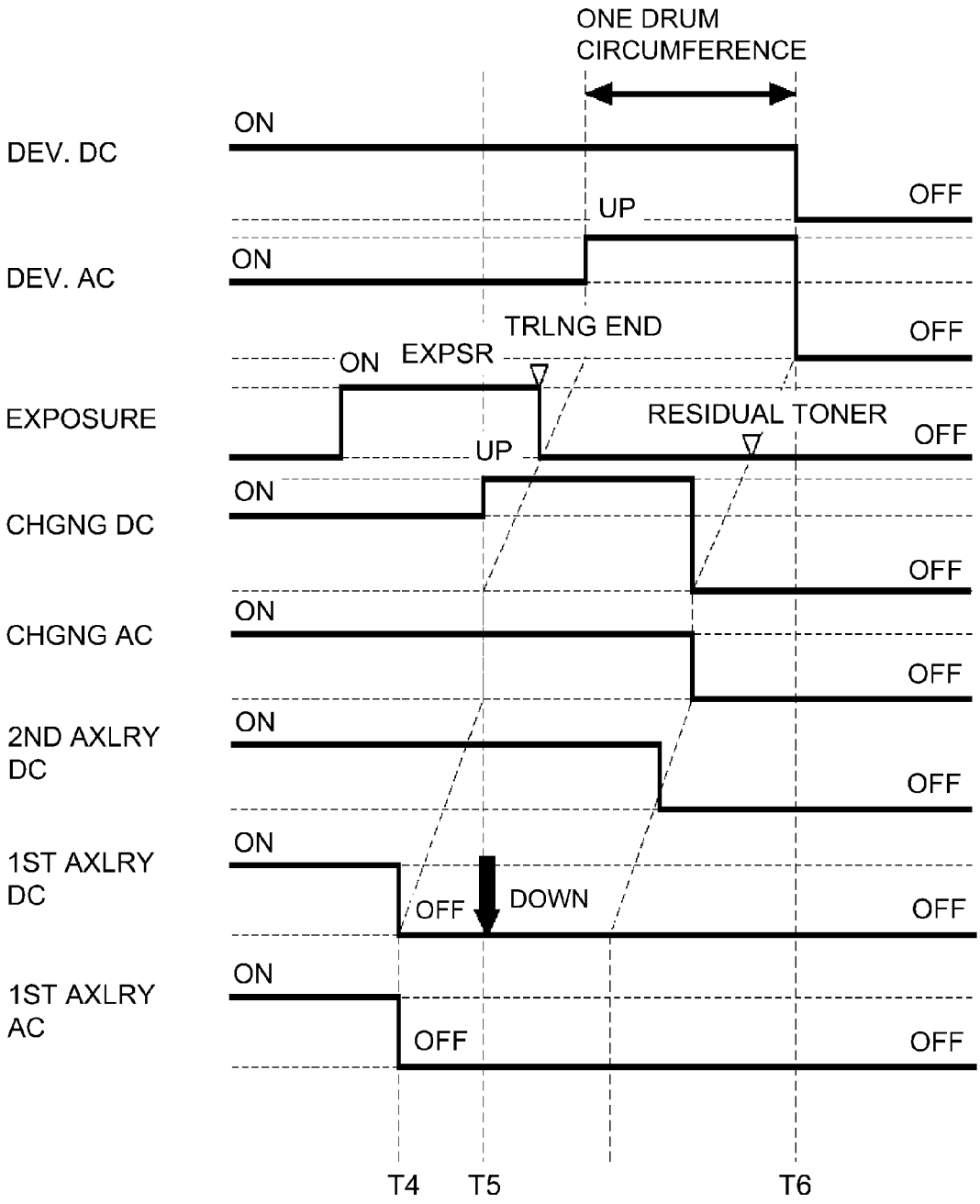

FIG. 9 is a timing chart of an operation in a high-voltage falling mode in Embodiment 2.

DESCRIPTION OF THE PREFERRED EMBODIMENTS

Hereinbelow, with reference to the drawings, the image forming apparatus of the present invention will be described based on embodiments. However, dimensions, materials, shapes and relative configurations of constituent elements described in the following embodiments should be appropriately changed depending on constitutions and various conditions of the image forming apparatus to which a concept of the present invention is applied. Therefore, unless otherwise noted specifically, the scope of the present invention is not limited to those in the following embodiments.

Embodiment 1

1. Schematic Structure of Image Forming Apparatus

Figure 1:
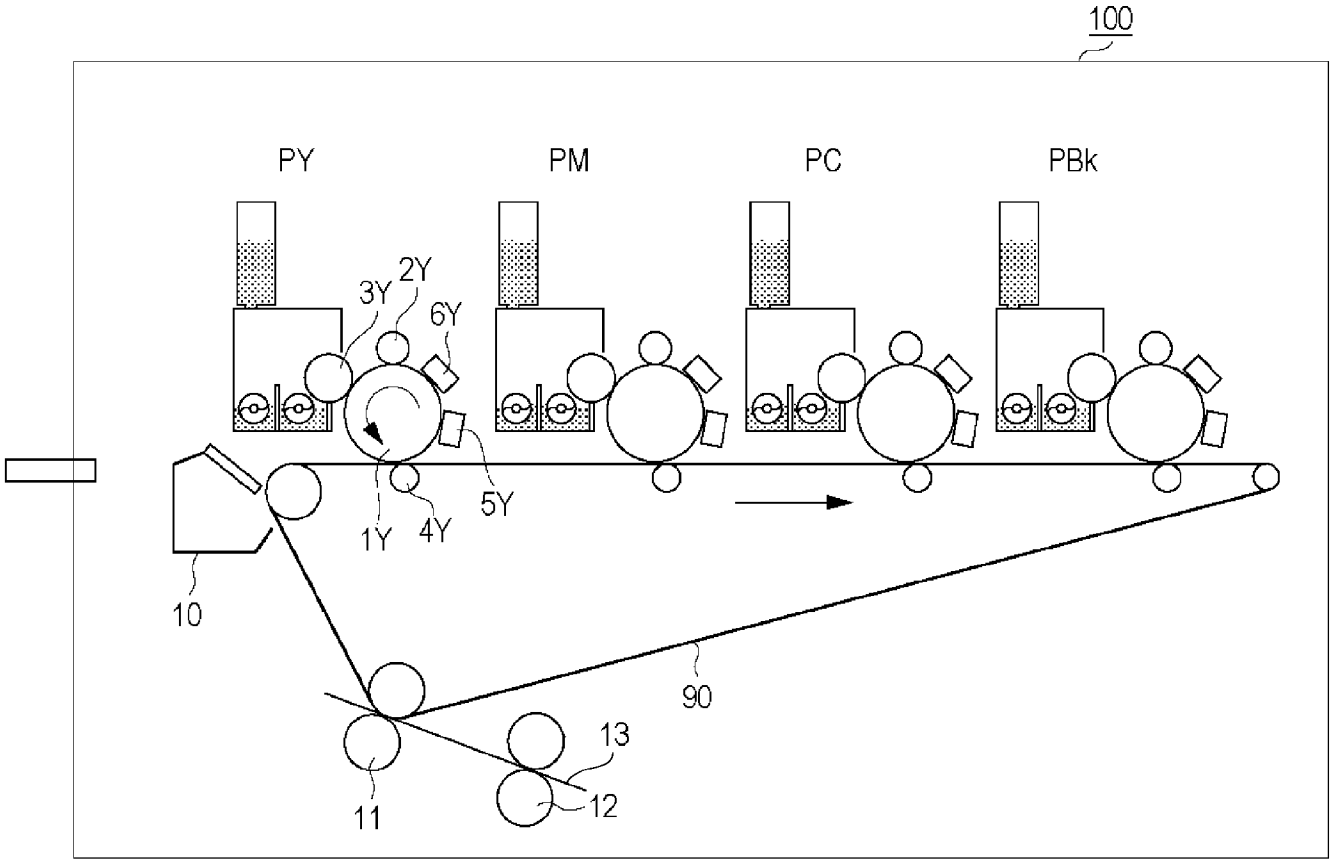
FIG. 1 is a schematic illustration of an image forming apparatus.

FIG. 1 is a schematic view for illustrating a schematic structure of an image forming apparatus in this embodiment. An image forming apparatus 100 includes process cartridges PY, PM, PC and PBk for a plurality of colors and forms toner images on the same transfer material 13 by successively transferring superposedly the toner images onto the transfer material 13. Further, the image forming apparatus 100 includes an intermediary transfer belt (hereinafter referred to as ITB) 90 as a toner image receiving material and a cleaning blade 10. The ITB 90 moves in an arrow direction. The transfer material 13 as a toner image receiving material taken out of an unshown sheet feeding cassette is supplied to a secondary transfer portion, formed between the ITB 90 and a transfer roller 11, via a registration roller 12. On the ITB 90 with respect to the direction of gravitation, the four image forming portions (process cartridges) PY, PM, PC and PBk are provided in contact to the ITB 90.

These image forming portions PY, PM, PC and PBk form on the ITB 90 the toner images of yellow, magenta, cyan and black, respectively. Further, the toner remaining on the ITB 90 without being transferred onto the recording material is removed by the cleaning blade 10. The transfer material (recording material or recording paper) 13 on which the toner images are transferred is conveyed to a fixing device by an unshown conveying belt. The fixing device including a pair of heating rollers fixes the toner images on the surface of the conveyed recording paper 13 and then discharges the image formed recording paper 13 to the outside of the image forming apparatus 100. Constitutions of the process cartridges (image forming portions) PY, PM, PC and PBk are basically the same and therefore in the following, the same constitution of the process cartridges will be described by collectively referring the process cartridges as a process cartridge P.

2. Schematic Structure of Image Forming Portion

Figure 2:
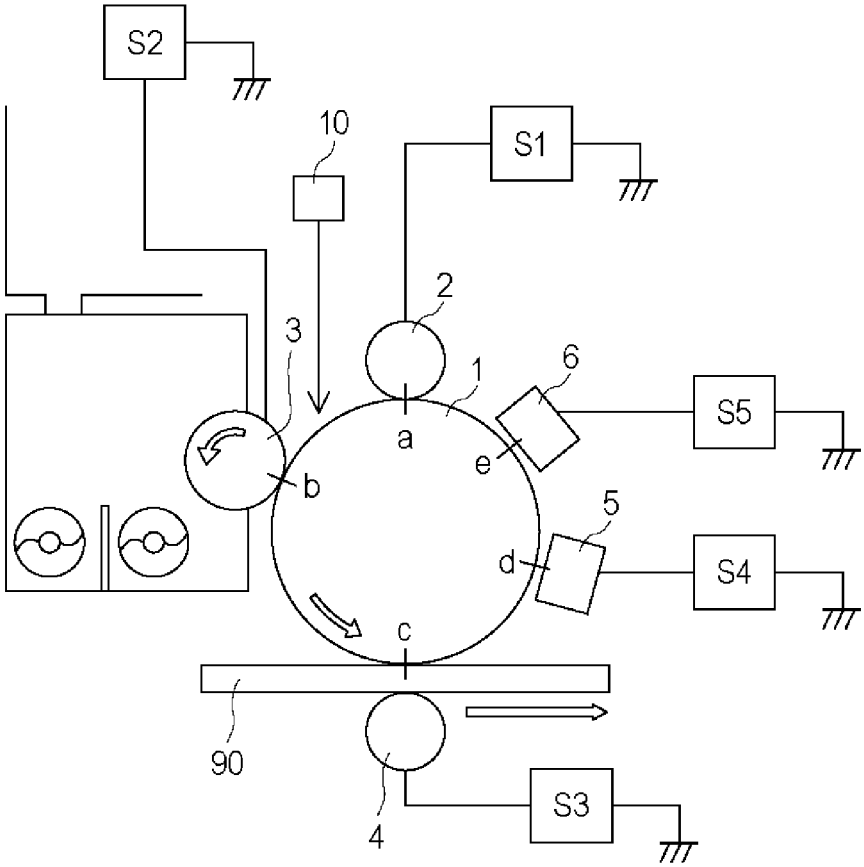
FIG. 2 is a schematic illustration of an image forming portion.

FIG. 2 is a schematic view for illustrating a structure of the process cartridge P as the image forming portion in this embodiment.

A photosensitive drum 1 as a cylindrical image bearing member (photosensitive member) is rotationally driven in an arrow direction at a predetermined peripheral speed. Then, a charging bias is applied to a charging roller 2 as a charging member (charging means) contacting the photosensitive drum 1, so that the photosensitive drum 1 is electrically charged to a predetermined potential. To the charging roller 2, a predetermined charging bias is applied from a bias voltage source (power source) S1.

The charged photosensitive drum 1 is exposed to (laser) light by a laser scanner 10 as an electrostatic image forming means, so that an electrostatic image is formed on the photosensitive drum (photosensitive member) 1. The photosensitive drum surface is lowered in potential at an exposed portion (light portion) and keeps a charge potential at an unexposed portion (dark portion). As a result, an electrostatic latent image corresponding to imagewise exposure by the lower scanner 10 is formed on the photosensitive drum 1.

Then, the electrostatic image is developed at a downstream side of the exposure portion. Specifically, the electrostatic image is developed with a toner by applying a predetermined developing bias from a bias voltage source S2 to a developing sleeve roller 3 provided in a developing device in which a developer containing the toner and a carrier is accommodated. Incidentally, an opposing portion between the developing sleeve roller 3 as a developing member and the photosensitive drum 1 is referred to as a developing portion (developing nip) b. In this embodiment, in the developing device, a pulverization toner is accommodated. In the case where the pulverization toner is used, the amount of the toner deposited and accumulated on an auxiliary charging brush for adjusting the electric charge of the toner is increased.

The toner image developed by the developing means is transferred, at a transfer portion, onto the intermediary transfer belt (ITB) 90 as the toner image receiving material (member). Specifically, the toner image is transferred from the photosensitive drum 1 onto the ITB 90 by applying a predetermined transfer bias from a bias voltage source S3 to a transfer roller 4 as a transfer means. Here, a transfer portion (transfer nip) c where the toner image is transferred onto the ITB 90 is formed by press-contact of the transfer roller 4 to the ITB 90 toward the photosensitive drum 1. Incidentally, in order to transfer the toner image onto the ITB 90 to the transfer roller 4, a voltage of a polarity opposite to a normal charge polarity of the toner is applied.

Further, a transfer residual toner remaining on the surface of the photosensitive drum 1 after the toner image transfer reaches the developing portion b via a charge portion a by continuous rotation of the photosensitive drum 1, thus being subjected to "simultaneous development and collection (cleaning)" by the developing device 3. The simultaneous development and collection is such a method that the transfer residual toner remaining on the photosensitive drum 1 after the transfer is collected by the developing device 3 by providing a fog-removing potential difference (Vback) which is a fog-removing bias (potential difference between a DC voltage applied to the developing means and a surface potential of the develop) during subsequent or later development after the transfer.

This simultaneous development and cleaning is effected together with an image forming process including charging, exposure, development and transfer in the case where an image region with respect to a rotational direction of the photosensitive drum 1 is longer than one-full-circumference of the photosensitive drum 1.

In order to effect the simultaneous development and cleaning, the image forming apparatus includes an adjusting means, provided downstream of the transfer portion and upstream of the charging portion, for adjusting the electric charge of the toner. The adjusting means in this embodiment is consisting of two members including a first adjusting member for performing the function of uniformizing the positive and negative polarities of the toners at the transfer portion and a second adjusting member for performing the function of providing the electric charge such that the polarity-uniformized toners are collected by the developing device.

An auxiliary charging brush 5 as the first adjusting member is provided downstream of the transfer portion c and upstream of the charging portion a. Further, an auxiliary charging brush 6 as the second adjusting member is provided downstream of the first adjusting member and upstream of the charging portion a. In this embodiment, the auxiliary charging brushes 5 and 6 are disposed in contact to the photosensitive member. Incidentally, the auxiliary charging brushes 5 and 6 may also be disposed in proximity to the photosensitive member so long as they can adjust the toner electric charge.

A voltage of a polarity opposite to the normal charge polarity of the toner is applied from a bias voltage source S4 to the auxiliary charging brush 5, and at a first adjusting portion (first auxiliary charging nip) d of the photosensitive drum 1, the toner remaining on the photosensitive member (image bearing member) is temporarily taken into (onto) the auxiliary charging brush 5. The toners remaining on the photosensitive member at the downstream side of the transfer portion are influenced by the voltage applied to the transfer portion and include the toner of a polarity identical to the normal charge polarity and the toner of a polarity opposite to the normal charge polarity of the toner in mixture.

The toners taken from the photosensitive drum 1 into the auxiliary charging brush 5 as the first adjusting member are, after their polarities are uniformized, electrostatically discharged (moved) onto the photosensitive drum 1 in a recharged state.

Further, the image forming portion includes the auxiliary charging brush 6 as the second adjusting member downstream of the first adjusting member and upstream of the charging means. To the auxiliary charging brush 6, a voltage of a polarity identical to the normal charge polarity of the toner is applied, so that the auxiliary charging brush 6 provides the electric charge, to the charge-uniformized toners by the auxiliary charging brush 6, such that the toners are subjected to the simultaneous development and collection (cleaning) by the developing device.

Specifically, at a second adjusting portion (second auxiliary charging nip) e formed between the auxiliary charging brush 6 and the photosensitive drum 1, the toners are supplied with predetermined electric charges of the normal toner charge polarity. Then, the toners which are electrostatically discharged (moved) from the auxiliary charging brush 6 and are charged to the normal toner charge polarity pass through the charging portion a and are, at the developing portion b, collected and developed simultaneously by the developing means 3. The above is a schematic constitution of the image forming apparatus.

Incidentally, in this embodiment, a nylon 12 brush of about $10^5$ Ω·cm was used as the upstream auxiliary charging brush 5, and a nylon brush of about $10^5$ Ω·cm was used as the downstream auxiliary charging brush 6.

3. Operation after Completion of Image Formation

Hereinafter, connection relationships among respective portions of the image forming apparatus in the above-described constitution will be described and thereafter a sequence from the completion of the image formation to a stand-by state will be described.

(Block Diagram)

Figure 3:
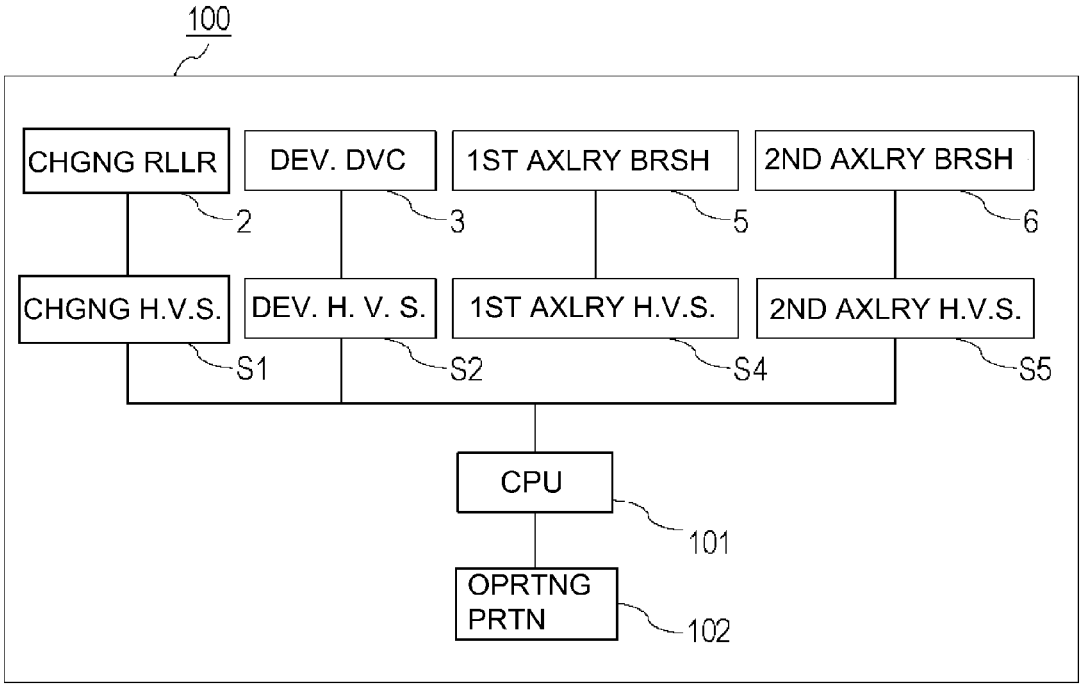
FIG. 3 is a block diagram of a control device of the image forming apparatus.

FIG. 3 is a block diagram for illustrating the connection relationships among the respective portions of the image forming apparatus. The image forming apparatus 100 includes a touch panel 102 as an operating portion for receiving an input from a user and a CPU (central processing unit) 101 as a control means for controlling the respective portions of the image forming apparatus. The CPU 101 controls the respective portions of the image forming apparatus in accordance with a program stored in RAM (random access memory). As a result, the image forming apparatus performs outputs along a timing chart and a flow chart which are described later. Then, the sequence when the image formation is ended will be described along the flow chart.

Comparative Embodiment

Conventional High-Voltage Falling Sequence

In the following, conventional high-voltage falling (lowering) timing in Comparative Embodiment will be described. High voltages are applied to respective portions (elements) of the image forming portion during continuous image formation but in order to suppress unnecessary electric power consumption, in a stand-by state, it is preferable that the high voltages are not applied (turned off). Part (a) of FIG. 4 is a timing chart for illustrating high-voltage falling timing of each of voltages applied to the charging roller, the auxiliary charging brushes and the like in a conventional embodiment as Comparative Embodiment. Each of oblique broken lines drawn to connect respective elements in the timing chart presents that the same region of the photosensitive member opposes associated elements each with indicated intersecting timing with rotation of the photosensitive member. A double-pointed arrow between the oblique broken lines in the timing chart represents one-full-circumference of the photosensitive drum.

During continuous image formation, a predetermined bias is applied to each of the charging means, the exposure means, the developing means and the auxiliary charging brushes. Then, in accordance with a print job inputted as a series of continuous image forming commands, the image forming apparatus subjects the charged photosensitive member to light exposure to form an image.

In the conventional embodiment, when the image formation is ended, the voltage applied to the first auxiliary charging brush is turned off after the electric charge of the transfer residual toner with respect to an image outputted on the final page is adjusted by the first auxiliary charging brush. That is, the application of the applied voltage during image formation is terminated in synchronism with timing when a trailing end (edge) of the image transferred on the intermediary transfer belt passes through the first auxiliary charging brush. Then, the CPU 101 successively falls (turns off) the respective high voltages in order to transfer the state of the image forming apparatus to the stand-by state. Specifically, in accordance with the commands from the CPU 101, the voltages applied to the respective voltage sources S1 to S5 are switched from ON to OFF.

In succession to the high-voltage OFF of the first auxiliary high-voltage source S4. The high-voltage application from the second auxiliary high-voltage source S5 to the second auxiliary charging member 6 is stopped. Incidentally, the applications of the high AC voltage and high DC voltage from the first auxiliary high-voltage source S4 to the first auxiliary charging member 5 are stopped simultaneously. Then, the applications of the high voltages (high AC voltage and high DC voltage) from the charging high-voltage source to the charging device and the application of the high voltage from the developing high-voltage source to the developing device are stopped.

Incidentally, during image formation, a DC voltage of −800 V is applied to the charging roller. Further, to the first auxiliary charging brush, a DC voltage of 600 V and an AC voltage of 400 V are applied. Further, to the second auxiliary charging brush, a DC voltage of −1000 V is applied. Here, the potential of the develop surface passing through the opposing portion to the first auxiliary charging brush to which the above bias is applied is −200 V. Therefore, in the conventional embodiment, a potential contrast (V1) between the photosensitive drum and the second auxiliary charging brush is 800 V.

In the sequence described in the conventional embodiment, the bias application is stopped at the time when the transfer residual toner at a trailing end of the image to be outputted on the final page passes through the first auxiliary charging brush. For that reason, the first auxiliary charging brush also recharges the transfer residual toner with respect to the image on the final page. In the above-described high-voltage falling sequence, the same auxiliary bias condition as that during the image formation is employed until the transfer residual toner corresponding to the image outputted on the sheet is charged by the auxiliary charging member.

Incidentally, after the sequence shown in FIG. 4, the sequence for discharging the toner deposited on each auxiliary charging brush onto the member may also be performed. When the amount of the toner deposited on the brush is large, a time required for the cleaning is prolonged, so that a time until the image forming apparatus state goes to the stand-by state is also prolonged.

(Conventional Control and Assumed Control)

As in the conventional embodiment, when the same voltage as the voltage applied during the image formation is applied to the first auxiliary charging brush until the transfer residual toner corresponding to the image to be outputted on the final page of the continuous image formation passes through the first auxiliary charging brush, the amount of the toner deposited on the brush is increased. The toner deposited on the auxiliary charging brush can be removed by performing a cleaning sequence in which the toner is discharged (moved) onto the photosensitive member but productivity is lowered by execution of the cleaning sequence.

Therefore, it would be considered that the toner deposition amount is reduced by lowering the voltage applied to the first auxiliary charging brush after the electric charge of the transfer residual toner deposited on the photosensitive member region where an image to be outputted on the final page of continuous images is to be formed. Specifically, it would be considered that timing of voltage application is adjusted as in a timing chart of (b) of FIG. 4 (assumed control). The continuous image formation is ended by the sequence as shown in (b) of FIG. 4, so that the toner deposition amount can be reduced as shown in FIG. 5. Incidentally, the control in this embodiment is preferred since the amount of the toner deposited and accumulated on (in) the first auxiliary charging brush 5 can be reduced in the constitution using the pulverization toner, but may also be applied to a constitution using a polymerization toner or the like.

FIG. 5 is a graph for showing the amount of the toner deposited and accumulated on (in) the first auxiliary charging member at the times of 25,000 sheets, 50,000 sheets, 75,000 sheets and 100,000 sheets as a total number of output sheets (print) when a sheet passing test such that an image with an image duty of 5% is outputted in a 2-sheet intermittent manner is conducted.

As is apparent from FIG. 5, in the conventional embodiment (Comparative Embodiment), at the time of 50,000 sheets, the amount of the toner deposited and accumulated on the first auxiliary charging member is 60 mg/cm$^2$. When the toner deposition (accumulation) amount exceeds 60 mg/cm$^2$, in the case where the image formation is repeated or the image formation with a high image ratio is continued, image defect resulting from electric discharge non-uniformity occurs.

On the other hand, in the assumed control (early-off sequence), the amount of the toner deposited and accumulated on the first auxiliary charging brush 5 at the time of 50,000 sheets is 40 mg/cm$^2$, so that the image defect resulting from the electric discharge non-uniformity was not generated.

Thus, by employing the assumed control, the amount of the toner deposited on the first auxiliary charging brush 5 as the first adjusting member can be reduced. However, when the bias application to the first auxiliary charging brush 5 is stopped in a state in which the transfer residual toner remains on the photosensitive member, the surface of the photosensitive member after passing through the first auxiliary charging brush 5 is not sufficiently electrically discharged. Specifically, the surface potential of the photosensitive member after passing through the first auxiliary charging brush 5 is lowered to −400 V. For that reason, the potential contrast between the photosensitive drum 1 and the second auxiliary charging brush 6 to which the voltage of −1000 V is applied is decreased to 600 V, so that the transfer residual toner is not sufficiently re-charged to the normal polarity. As a result, the simultaneous development and collection function is lowered, so that image defect which is called "fog" such that the toner is unintendedly deposited on a non-image portion of the image to be outputted occurs.

(High-Voltage Early-Off Sequence in this Embodiment)

Therefore, in this embodiment, when the image formation is ended, the voltage applied to the first auxiliary charging brush 5 as the first adjusting member is lowered and at the same time, the voltage applied to the developing device 3 as the developing means is also controlled. The sequence will be described along a timing chart and a flow chart.

(Timing Chart)

FIG. 6 is a timing chart for illustrating the high-voltage falling sequence at the time of completion of the image formation in this embodiment. In the timing chart, oblique lines are used for explaining movement of the same region (of the photosensitive member surface) with the rotation of the photosensitive member. Also in the sequence control in this embodiment, the high-voltage application to the first auxiliary charging brush 5 is turned off (lowered to 0 V) earlier than the conventional control, so that the amount of the toner deposited on the first auxiliary charging brush 5 is suppressed. That is, a predetermined voltage lower in absolute value than the voltage applied to the first adjusting member is applied to the first adjusting member until the rear end passes through the first adjusting member.

Here, in order to reduce the toner deposition amount on the first auxiliary charging brush 5 as the first adjusting member, when the applied voltage is changed, earlier than the conventional control, to a voltage (0 V in this embodiment) lower than the voltage applied during the image formation, the surface potential of the photosensitive member is lowered. For that reason, when the photosensitive member region passing through the opposing portion to the first auxiliary charging brush 5 to which the predetermined voltage lower than the voltage applied during the image formation passes through the second auxiliary charging brush 6, the transfer residual toner cannot be adjusted so as to have the normal charged polarity and a desired electric charge amount. Therefore, a lowering in transfer residual toner collecting efficiency is suppressed by increasing an AC voltage applied to the developing device as the developing means in the whole region corresponding to the portion where the voltage applied to the first auxiliary charging brush is lowered. Specifically, in a period of "UP" in FIG. 6 (i.e., in a period from the turning-off ("OFF") of the first auxiliary charging brush to an end of one full turn of the photosensitive drum (through one-full-circumference)), the AC voltage applied to the developing device is increased from 1650 Vpp (peak-to-peak voltage), used during the normal image formation, to 1850 Vpp. That is, control is effected so that the AC voltage larger in peak-to-peak voltage than the AC voltage applied to the developing means until the front end of the photosensitive member region reaches the developing means is applied to the developing means when the front end of the photosensitive member region reaches the developing means. As a result, the lowering in developer collecting property can be suppressed while suppressing the amount of the toner deposited on the first auxiliary charging brush 5.

Incidentally, a DC voltage applied to the developing device 3 is −620 V in this embodiment and is not changed also in the period in which the peak-to-peak voltage value of the AC voltage is increased. Further, when the applied bias of the Vpp (peak-to-peak voltage) is amplified up to 1850 Vpp, the image defect such as abnormal electric charge occurs and therefore the amplification of the AC voltage value may desirably be effected outside an image forming range. It may also be possible to change (absolute value) of a developing voltage applied in order to enhance the transfer residual toner collecting property by the developing means.

In this method, in order to suppress deposition of the magnetic carrier on the photosensitive drum, a photosensitive member surface potential Vd (−800 V) and a developing potential Vdc (−620 V) are used while keeping a certain Vback (=Vd−Vdc=180 V). For that reason, in order to ensure a desired Vback at the developing portion b at the photosensitive drum surface charged by the charging means, slope high-voltage control such that applied high voltages are gradually increased up to desired Vd and Vdc is effected.

This timing when the AC voltage is applied to the developing device may desirably be after end of the slope high-voltage control in order to completely prevent (eliminate) the influence on the Vback during the slope high-voltage control. When the AC voltage is applied during the slope high-voltage control, there is a possibility that a spike occurs when the AC voltage application is turned on and thus the Vback is microscopically increased thereby to cause the deposition of the carrier from the developing sleeve onto the photosensitive drum.

In this method, the bias application is stopped at the time when the transfer residual toner at the trailing end of the image passes through the first auxiliary charging member and therefore the whole transfer residual toner is re-charged. This is also true for the bias application stop timing of the second auxiliary charging member.

(Flow Chart)

The sequence described along the timing chart of FIG. 6 will be supplementarily described along a flow chart. FIG. 7 is the flow chart for illustrating the high-voltage falling sequence during the image formation in this embodiment. When the image forming apparatus state is changed from the state of the end of the image formation to the stand-by state, the CPU 101 as the control means controls the high-voltage sources (S1 to S5) in the following manner in accordance with a program stored in RAM.

The CPU 101 lowers the voltage applied to the first auxiliary charging brush 5 with timing (T1) when the rear end of the region in which the electrostatic image the electrostatic image corresponding to an image, to be finally transferred onto the toner image receiving material, of a series of images designated by a job is to be formed passes through the first auxiliary charging brush 5 (S101, S102).

Then, in synchronism with timing (T2) when the region where the photosensitive member surface potential is changed by the first auxiliary charging brush 5 to which the low voltage is applied reaches a position where the region opposes the developing device 3, the AC voltage applied to the developing device 3 is increased (S103, S104).

Then, during one full turn of the photosensitive drum (through one-full-circumference), the AC voltage higher than the voltage applied during the image formation is applied to the developing device 3 (S105). In other words, for a period until the transfer residual toner corresponding to the image outputted on the final page passes through the developing device 3, the AC voltage higher than the voltage applied during the image formation is applied to the developing device 3. Thereafter, the high-voltage application to the developing device 3 is turned off (S106/T3).

4. Image Evaluation Test 1

Comparison of effects among the cases where the sequences in the conventional embodiment, assumed control and this embodiment are used is made. Specifically, an image with an image duty of 30% was formed in a 2-sheet intermittent manner and then was subjected to a functional evaluation test by eyes. Test results are summarized in Table 1.

TABLE 1

| | 10,000 | 30,000 | 50,000 (sheets) |
|---|---|---|---|
| COMP. EMB. | ○ | ○ | x |
| ASSD. CNT. | ○ | Δ | Δ |
| EMB. 1 | ○ | ○ | ○ |

Here, in Table 1, "o" represents that a good image is outputted. "Δ" represents that a slight fog image is outputted. "x" represents that an observable defective image is outputted.

In the assumed control, an image defect of a fog was generated on the image in the neighborhood of 30,000 sheets. However, in the sequence in this embodiment, the image defect was not generated even when the sheet number exceeds 50,000 sheets.

FIG. 8 is a graph showing a relationship between a transfer residual toner collecting property (rate) by the developing device and an electric field intensity between the photosensitive drum and the developing device.

In a constitution in which the developing AC voltage is 1650 Vpp (Vback: 180 V) equal to that applied during the image formation, the electric field intensity is 3.35 kV/m, so that when the early-off sequence for reducing the amount of the toner deposited on the auxiliary charging brush is executed, the collection rate of the transfer residual toner cannot be made 100%. On the other hand, as in this embodiment, the electric field intensity is made 3.62 kV/m by increasing the developing AC voltage to 1850 Vpp (Vback: 180 V), so that the transfer residual toner can be sufficiently (about 100%) while reducing the amount of the toner deposited on the auxiliary charging brush.

As described above, after the transfer residual toner deposited on the region where the image to be outputted finally on the sheet during the continuous image formation is to be formed is charge-adjusted by the first auxiliary charging brush, the applied voltage is switched to the voltage smaller than the voltage applied during the image formation, so that the simultaneous development and collection function can be maintained while reducing the toner deposition amount.

Embodiment 2

In the following, constituent members (portions) similar to those in Embodiment 1 are represented by the same reference numerals (symbols) and will be omitted from description. In Embodiment 1, the problem that the transfer residual toner collecting performance is lowered with the reduction in amount of the toner deposited on the auxiliary charging brush was suppressed by adjusting the developing bias. In this embodiment, the problem that the transfer residual toner collecting performance is lowered with the reduction in amount of the toner deposited on the auxiliary charging brush is suppressed by adjusting a charging bias.

As described above, there is a close relation between the transfer residual toner collecting property by the developing device and the electric field intensity. In this embodiment, a method of enhancing the Vback is employed as the method of enhancing the electric field intensity. Specifically, the Vback is increased to 240 V (electric field intensity: 3.65 kV/m) by increasing the DC voltage applied to the charging means, thereby to realize the transfer residual toner collecting property similar to that when the developing AC bias Vpp is increased to 1850 Vpp.

As in this embodiment, in the constitution in which the charging voltage is changed, compared with Embodiment 1, the charging performance from the charging means to the photosensitive drum is fluctuated depending on an environment and a durability state and therefore it is difficult to execute the constitution. On the other hand, compared with the constitution in which the AC voltage applied to the developing device is increased, the constitution in this embodiment is advantageous in terms of a cost reduction and temperature-rise suppression in the image forming apparatus correspondingly to elimination of the high-voltage AC power source.

FIG. 9 is a timing chart for illustrating the high-voltage falling sequence with completion of the image formation in this embodiment. Similarly as in Embodiment 1, when the front end of the region opposing the first auxiliary charging brush 5 to which the voltage lower than the voltage applied during the image formation passes when the image formation is ended, the DC voltage applied to the charging means is made higher than that applied during the image formation (T5). Specifically, the DC voltage applied to the charging means is increased so that the Vback is 240 V. Then, the charging voltage application is turned off at the time (T6) when the rear end of the region in which the transfer residual toner corresponding to the image, to be transferred finally onto the toner image receiving material, of a series of images designated by a job.

As a result, the transfer residual toner corresponding to the image to be outputted on the final page can be satisfactorily collected by the developing device while suppressing the amount of the toner deposited on the first auxiliary charging brush.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 118272/2011 filed May 26, 2011, which is hereby incorporated by reference.

What is claimed is:

1. An image forming apparatus comprising:

an image bearing member;

charging means for electrically charging said image bearing member;

an electrostatic image forming portion for forming an electrostatic image on said image bearing member electrically charged by said charging means:

developing means for developing with a toner the electrostatic image formed on said image bearing member simultaneously with collection of a toner remaining on said image bearing member;

transfer means for transferring a toner image, formed on said image bearing member, onto a toner image receiving material;

a first toner charging member, provided downstream of said transfer means and upstream of said charging means with respect to a rotational direction of said image bearing member, for electronically charging the toner remaining on said image bearing member;

a second toner charging member, provided downstream of said first toner charging member and upstream of said charging means with respect to the rotational direction, for electrically charging the toner remaining on said image bearing member by being supplied with a voltage of a polarity identical to a normal charge polarity of the toner; and control means for controlling said first toner charging member and said developing means, wherein application of a predetermined voltage to said first toner charging member starts during a period from a time when a rear end of a region in which the electrostatic image corresponding to an image, of a series of images designated by a job, to be finally transferred onto the toner image receiving member is to be formed passes through said first toner charging member until a time when the rear end passes through said charging means, wherein the predetermined voltage is lower in absolute value than a voltage applied to said first toner charging member until the time when the rear end passes through said first toner charging member, and wherein a first AC voltage is applied to said developing means when a front end of a region of said image bearing member opposing said first toner charging member to which the predetermined voltage is applied reaches said developing means, wherein the first AC voltage is higher in peak-to-peak voltage than a second AC voltage applied to said developing means until the time when the front end reaches said developing means.

2. An image forming apparatus according to claim 1, wherein the predetermined voltage lower than the voltage applied to said first toner charging member during image formation is 0 V.

3. An image forming apparatus according to claim 1, wherein said control means controls, when the region of said image bearing member opposing said first toner charging member to which the predetermined voltage is applied reaches said charging means, a DC voltage applied to said charging means so as to be higher than that applied during image formation.

* * * * *